United States Patent [19]

Zink et al.

[11] 4,188,183

[45] Feb. 12, 1980

[54] BETTER USE OF GAS DISCHARGE ENERGY FOR SMOKE SUPPRESSION

[75] Inventors: John S. Zink; Robert D. Reed; Robert E. Schwartz, all of Tulsa, Okla.

[73] Assignee: John Zink Company, Tulsa, Okla.

[21] Appl. No.: 779,595

[22] Filed: Mar. 21, 1977

[51] Int. Cl.[2] ..... F23D 15/00

[52] U.S. Cl. ..... 431/202; 239/565; 431/5; 431/175

[58] Field of Search ..... 431/202, 175, 5; 239/565; 23/277 C

[56] References Cited

U.S. PATENT DOCUMENTS

| | | | |
|---|---|---|---|
| 1,884,894 | 10/1932 | Sherwood | 431/175 |
| 1,973,935 | 9/1934 | Thorson | 431/175 |

*Primary Examiner*—Edward G. Favors
*Attorney, Agent, or Firm*—Head, Johnson & Chafin

[57] ABSTRACT

Apparatus for the smokeless combustion of gases, supplied at substantial pressure, such that they will aspirate the required combustion air when discharged to atmospheric pressure. The apparatus comprises a plurality of spaced apart burner assemblies, each of which has a plurality of orifices arranged in a circular symmetrical pattern. Each burner assembly comprises a vertical tube supplying gas, with a plurality of short substantially radial arms, each of which has a plurality of orifices in its top surface. The arms themselves are tilted upwardly at a selected angle to the horizontal so that the orifices that are perpendicular to the arms will provide gas jets which will intersect each other along the axis of the assembly. In another embodiment, the top surface of the arms form a plane fingered plate of substantial thickness. The orifices are drilled at a selected angle toward the axis, in the top surface of the plate. In a third embodiment, each burner assembly comprises a toroid, or circular ring of pipe, with a plurality of circumferentially spaced orifices in the top surface of the pipe inclined at a selected angle to the plane of the pipe.

16 Claims, 9 Drawing Figures

BETTER USE OF GAS DISCHARGE ENERGY FOR SMOKE SUPPRESSION

BACKGROUND OF THE INVENTION

Field of the Invention

This invention lies in the field of gas burning devices.

More particularly this invention lies in the field of apparatus for burning gases which are under sufficient pressure, so that they can issue at substantially sonic velocity from a plurality of orifices.

Still more particularly this invention concerns apparatus for burning gases which are discharged from substantial pressure, whereby a plurality of jets are directed in the form of a cone, so that the gas which issues from the orifices will entrain air for combustion and will form a compact rod-like frame, which is separated from other similar flames, so as to provide adequate free air for aspiration into the flame, and to turbulently mix with the burning gas for complete and smokeless combustion.

In the prior art many embodiments have been shown of apparatus for burning gases which have been discharged from substantial pressure, so that they induce combustion air. However, for complete and smokeless combustion there must be full assurance that there will be sufficient combustion air induced, and that there will be adequate mixing of the air and gas so as to insure complete and smokeless combustion. Where the orifices are placed at more or less distributed spacing over an area, there is a large diameter column of gas that makes it difficult for air to be available for entrainment, to mix with the gas in the central region of the column, for example, and therefore, it is difficult to get complete mixing and smokeless combustion without the additional energy means, such as steam for entraining air, and turbulently mixing the air and gas.

SUMMARY OF THE INVENTION

It is a primary object of this invention to provide a plurality of burner assemblies for burning gas discharged from substantial pressure, and to provide means for supplying adequate atmospheric air, so that there will be substantial aspiration of air and turbulent mixing of air with the gas to provide smokeless combustion.

In the art of smokeless flare-burning of smoke-prone gases, and where the gases for flare-burning are available at pressures capable of discharge of gas at approximately 75% of sonic (critical) velocity or more, it is known that gas velocity-derived energy is capable of smokeless burning of some gases because of great entrainment of air with gases. While generally satisfactory for less smoke-prone gases, this process is less than satisfactory for more smoke-prone gases such as olefins, diolefins, and acetylenes, as well as aromatics, where the weight-ratio of hydrogen to carbon falls as low as 0.166 or lower.

The solution makes greatly improved use of gas discharge energy for enhanced air aspiration and entrainment, for the complete burning of discharged gases, where complete burning can be defined as for the carbon content of the gases to avoid escape of any unburned carbon from the burning.

We have discovered that narrow, stiff, and rod-like flames above each of a plurality of burning assemblies is required in order to prevent burning interference (with resulting smoking) in the case of immediately adjacent assemblies, where there was wind-induced co-mingling of separate flames. Because of the great mass (volume) of gases, which demands extremely rapid access of and mixture with air, as in the case of ethylene (H/C=0.166) where air demand is approximately 14.9 C F air/C F ethylene, or in the case of propylene (H/C=0.166) where air demand is approximately 21.44 C F air/C F propylene, there is simply not great enough access area for air to the gas. Neither is there adequate time for creation of a smokeless burning state for the burning of particularly smoke-prone gases.

The reduction of mass (volume) of gas within the discharged stream will enhance air-to-gas access to a satisfactory degree. However, the demand for a stiff, rod-like, and upwardly projected flame still exists for avoidance of smoking due to co-mingled flames in windy conditions, which are typical of outdoor operation. Decrease in the mass (volume) of gas flow per port (increase in number of ports for a specific mass volume) of gas reduces the stiffness of vertical projection of the flame, and makes the flame more vulnerable to the wind. The invention pertains to means for generating and retaining the stiff upward projection of flame, when the mass (volume) of gas flow per port is reduced sufficiently to allow adequate gas-air mixture for avoidance of smoke emission from the burning.

These and other objects are realized and the limitations of the prior art are overcome in this invention by providing a plurality of unit burner assemblies, which are spaced laterally from each other sufficiently, so as to provide an air space between each of the burners, through which atmospheric air can be supplied to and surround each of the individual burner assemblies.

It is important that each of the burner assemblies will provide one composite flame of substantial dimension and sufficient kinetic energy in the gas, to aspirate sufficient air for complete combustion of the gas, and to permit the flow of atmospheric air to the rapidly moving column of gas so as to insure complete and smokeless combustion.

In this type of burning there will be jets of gas provided which over a limited transverse area will be directed in a conical form to a single flame which will extend along the axis of the burner. This provides a stiff, rod-like flame because of the high velocity of the gas, and is isolated laterally from each of the other similar burners so as to provide sufficient air space between the flames, whereby atmospheric air can be drawn in to surround each of the burners whether on the outside or the inside of the total assembly, and thus to provide adequate air for the combustion and mixing with the gas.

Each of the assemblies consists of a pipe of selected diameter for supply of gas, which provides in a more or less transverse plane, a plurality of orifices which are directed upwardly and radially inwardly, to the axis of the pipe. In one embodiment, the orifices are in a plurality of outwardly extending finger-like tubes, with orifices in their top surface. The tubes can be tilted upwardly at a selected angle A, while the orifices are directed perpendicular to the axis of the tube, thus providing for all of the jets of gas to be directed inwardly and to meet at a point on the axis, at a selected distance above the arms.

In another embodiment, the radial tubes are formed with a series of box-like fingers, covered by a fingered plate, of sufficient thickness, that the orifices can be drilled at inclined angles into the top surface. The angles of the orifices are such that the jets will converge substantially at a point along the axis of the tube or pipe supplying the gas.

In another embodiment the burner comprises a toroidal ring having a plurality of orifices drilled into the top surface, and uniformly circumferentially spaced. Instead of being drilled perpendicular to the plane of the toroid they will be drilled at a selected angle A to the vertical, so that the jets which issue from these orifices will lie along the surface of a cone.

BRIEF DESCRIPTION OF THE DRAWINGS

These and other objects and advantages of this invention and a better understanding of the principles and details of the invention will be evident from the following description taken in conjunction with the appended drawings in which.

DESCRIPTION OF THE PREFERRED EMBODIMENT

Figure 2:
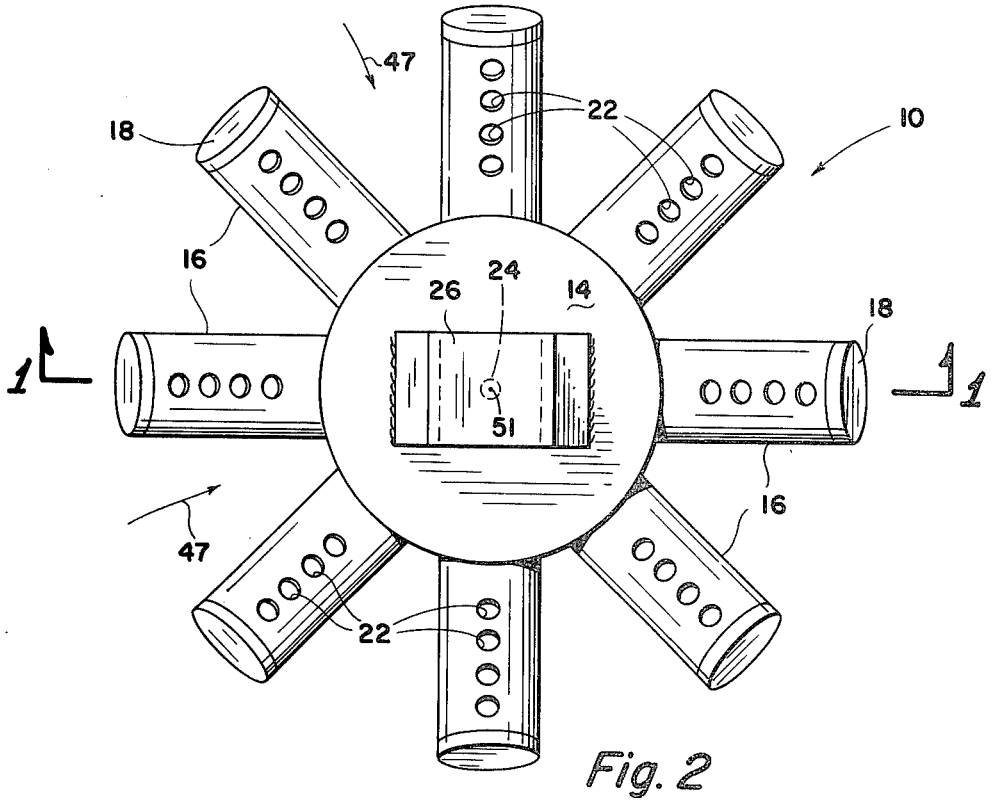
FIGS. 1 and 2 represent an axial section and an end view of one embodiment of this invention.
Figure 1:
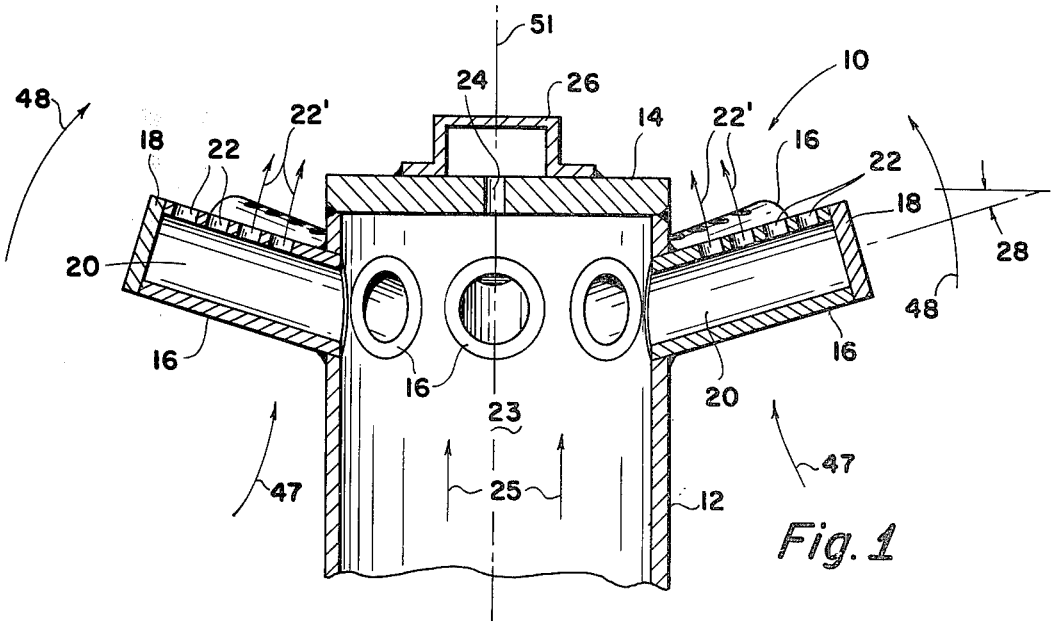

Referring now to the drawings and in particular to FIGS. 1 and 2 there are shown two views of one embodiment of the burner assembly of this invention, indicated generally by the numeral 10. There are a plurality of radial arms 16, inserted into and sealed to the burner tube 12 by means of welds, as is well known in the art. The outer ends 18 of the arms are closed. A plurality of orifices 22 are drilled along the top surfaces of the arms. These orifices will be of greater diameter than the normal thickness of the pipes 16, and therefore the gas jets will be directed substantially perpendicular to the axis of the arms. By tilting the arms, by the selected angle 28, the directions of the jets 22' of gas that will issue from the orifices 22, in each of the arms, will flow inwardly and upwardly, and will join at a point on the extended axis 51 of the pipe 12.

The top end of the pipe 12 is closed by a plate 14 which is attached as by welding. There can be, if needed, at least one orifice 24 in the center of the top plate 14 which is covered by a metal strap 26 in a hat section (also 44 and 46 of FIG. 3), which is attached by welding to the plate 14 or to 34 of FIG. 3. In operation, the gas that flows through the jet 24 strikes the strap 26 and is deflected and slowed down to the point that, in the vicinity of the center of the top of the plate 14, there will be a quiet area of gas, that can burn steadily, and provide ignition for the high speed jets of gas 22', which may have a tendency to burn unsteadily, and therefore the continuous flame nearby will provide means to reignite the jets as they may tend to extinguish. Use of 24–26 and 44 and 46 is optional for hard-to-ignite gases.

Figure 4:
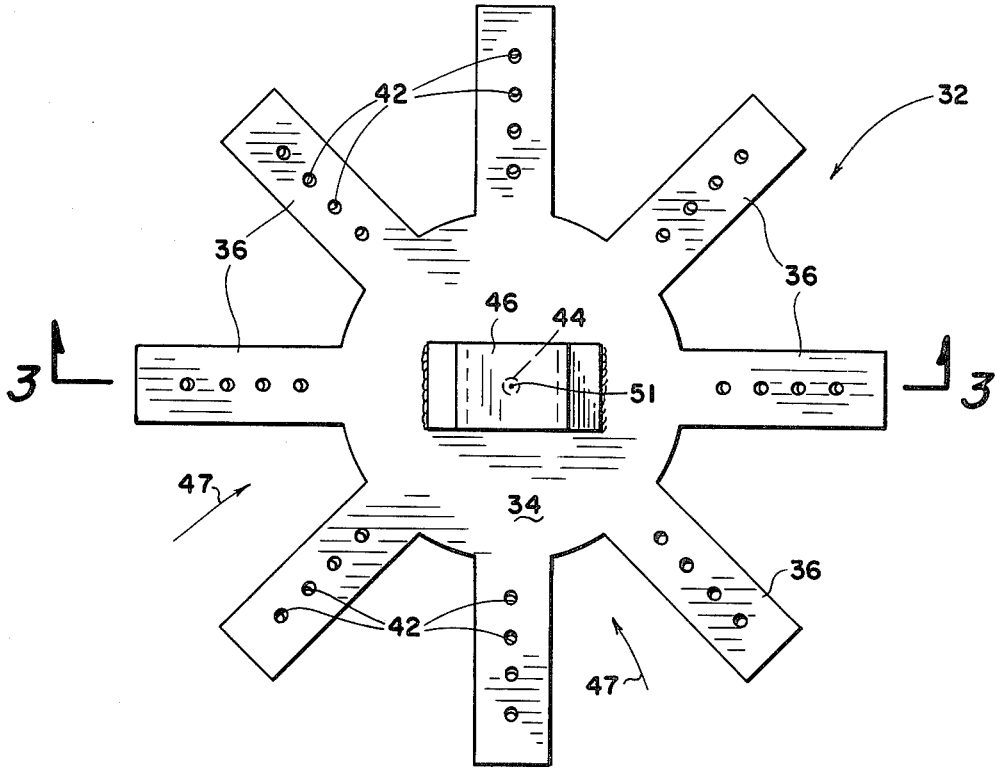
FIGS. 3 and 4 represent a second embodiment in an axial section and an end view.
Figure 3:
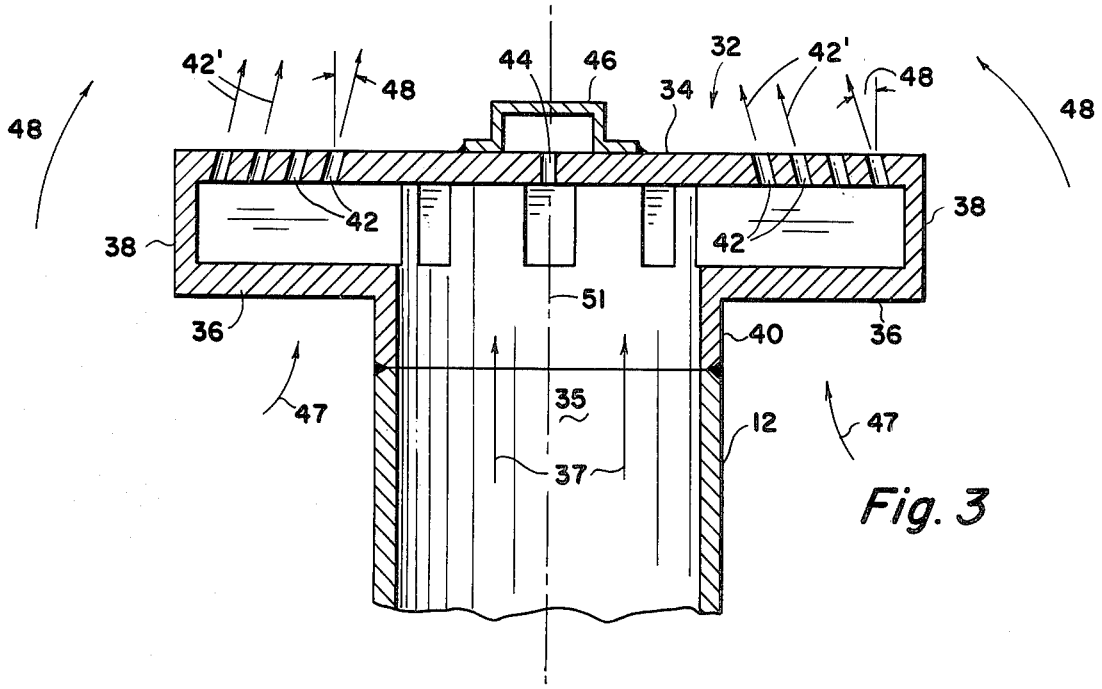

Referring now to FIGS. 3 and 4, there are two views of a second embodiment of a burner assembly, like the embodiment of FIGS. 1 and 2. This embodiment also has a plurality of radial fingers 36 in an orifice spider 40, which is attached as by welding to the top of the gas supply, or burner tube 12. The principal difference between the embodiment 32 and the previously described embodiment 10, lies in the fact that the top plate 34 which provides a cover plate over the central circular portion and over the fingers, comprises a single plane metal plate. This plate 34 is of sufficient thickness, such that the orifices 42 are longer than their diameter, and therefore provide directivity to the jets 42', which issue from the orifices. Therefore, in view of the thickness of the plate 34 the orifices 42 are drilled at a selected angle 48 to the vertical, in radial planes so that the jets from all of the radial arms or fingers will move inwardly and upwardly, and will join at a point on the axis extended 51 of the pipe 12. From that point, there will be a very strong stiff flame moving upwardly along the axis of the burner. As in the case of the burner assembly embodiment 10, there is an axial orifice 44 in the top plate 34, which is also covered with a hat section strip 46 to provide a quiet flame in the space above the top of the plate 34 which can rekindle the jets of gas, as turbulent winds or flame instability tend to extinguish them.

Figure 6:
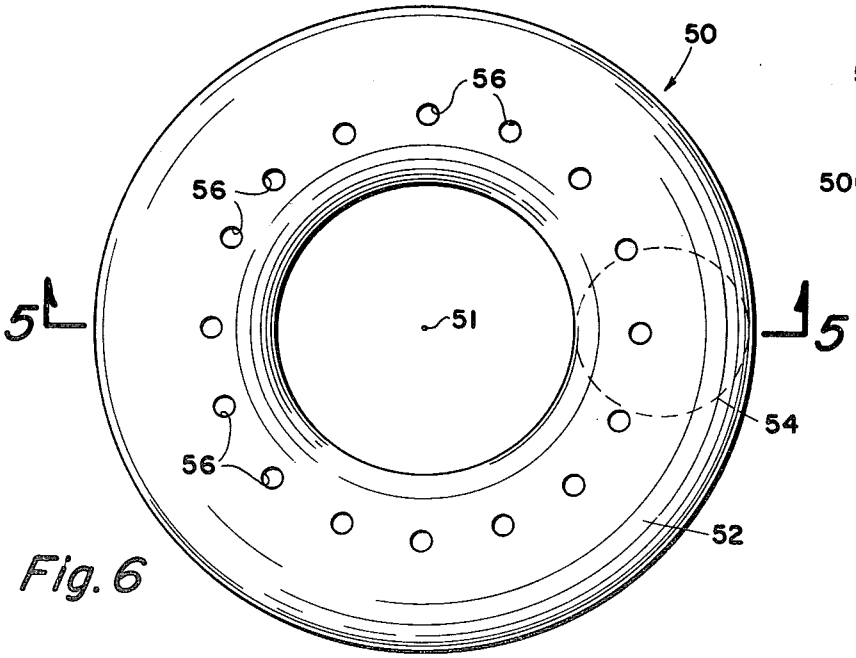
FIGS. 5 and 6 illustrate a third embodiment in a vertical section and an end view.
Figure 5:
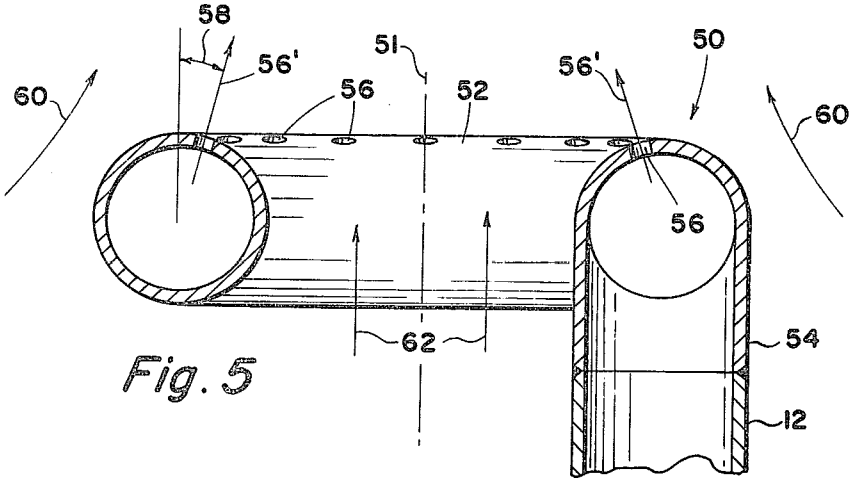

Referring now to FIGS. 5 and 6, there is a third embodiment indicated generally by the numeral 50, which comprises a toroidal pipe 52 of circular cross-section, which has a supply pipe 54, which can be attached by welding to the burner pipe 12. There are a plurality of orifices 56 drilled in the top surface of the toroid 52. These, as shown in FIG. 5, are inclined at an angle 58 to the vertical in radial planes, so that the jets of gas will be directed upwardly and inwardly, to intersect each other at a point on the extended axis 51.

The high velocity jets 56' that issue from the orifices 56 will cause entrainment and aspiration of air, not only from the outside, in accordance with arrows 60, but also upwardly through the central opening in accordance with arrows 62, so that both sides of the jets, both inside the cone and outside the cone, will be available to atmospheric air, whereby the high velocity gas jets will aspirate adequate-combustion air which will be thoroughly and turbulently mixed with the gas.

Referring to FIGS. 1 and 2, there are shown arrows 47 directed inwardly and upwardly into the spaces between each of the fingers 16. In FIG. 1, the arrows 47 are shown as flowing inwardly and upwardly up between the fingers to supply atmospheric air to the walls of the jets 22'. Also there will be aspiration of air from the outside the conical flame, in accordance with arrows 48 upwardly and inwardly, toward the cone of gas and flame, so that there will be adequate aspiration of air and thorough mixing with the high velocity jets.

In FIGS. 3 and 4 there are also shown the same arrows 47 indicating the inflow and upward flow of air in between the fingers and also the arrows 48 showing the aspiration of air from around the burner assembly out along the outside of the cone of gas.

Figure 7:
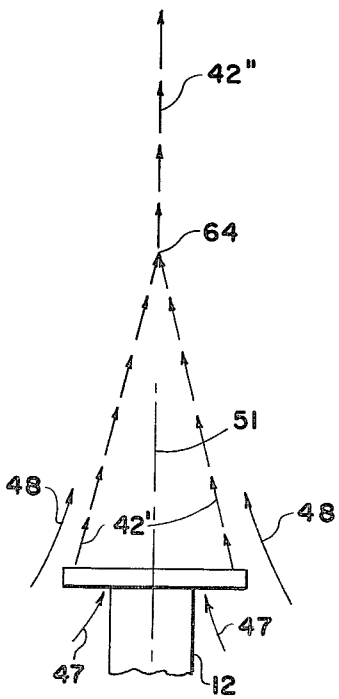
FIGS. 7 and 8 indicate the angles of flow of the jets of gas and flame.
Figure 8:
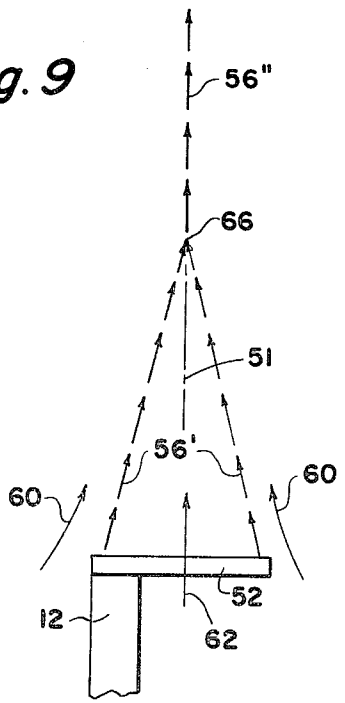

In FIGS. 7 and 8 are shown schematically two assemblies. FIG. 7 similar to those of the assemblies 10 and 32 utilizing a plurality of radial fingers, with upwardly and inwardly directed orifices and including jets 42', as in FIGS. 3 and 4, which join together at a point 64 and then continue upwardly as vertical jet and flame 42'', along the axis 51.

In FIG. 8 a similar situation is shown schematically for the assembly 50 of FIGS. 5 and 6. Here the jets 56' flow along the surface of the cone and join at a point 66 where the gas and air and flame continue up as a long, stiff, rod of flame 56'', along the axis 51 of the burner assembly.

The high velocity conical jet system, which tapers to a narrow rod-like flame, because of its high velocity, and because it is surrounded by air, can aspirate sufficient air along the outside in accordance with arrows 60, and air on the inside of the toroid 52 in accordance with arrows 62 so that the wall of gas and flame is supplied with air inside and outside, which provides a very turbulent mixing and therefore promotes a complete and smokeless combustion.

In FIG. 7 a similar situation exists except, here the air moves inwardly and upwardly as arrows 47 in between the fingers and on the outside in accordance with arrows 48 up along the outside of the cone of gas and flame, and continues up in the upper portion 42''.

Figure 9:
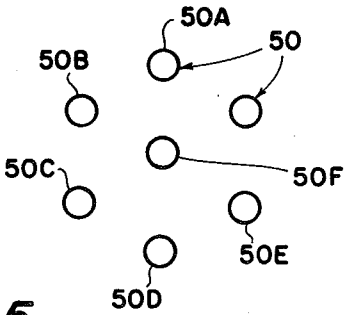
FIG. 9 illustrates a plan view of a plurality of burner assemblies.

While there is only one each of the various types of burner assemblies 10, 32, and 50 which are illustrated, an actual burning system would utilize a plurality of such separated, stiff, rod-like flames. As illustrated schematically in FIG. 9 for example, the lateral spacing between the separate burners 50A, 50B . . . 50F would be great enough so that there would be adequate inflow of air, so that each of the separate burner assemblies would be surrounded by air space, and therefore provide adequate inspiration of combustion air.

Also, the utilization of a strongly directive rod-like flame would make the flames less susceptible to transverse winds. In a normal type burner where there are many closely spaced orifices, a thick cylindrical column of gas flows upwardly, which makes it difficult for the penetration of air into the center of the column, unless it is driven in, or carried in, by very high velocity jets and steam, and so on. These rod-like flames would be less susceptible to wind and would prevent the co-mingling of adjacent flames, and therefore would be reliably and constantly non-smoke producing flames.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the appended claim or claims, including the full range of equivalency to which each element thereof is entitled.

What is claimed is:

1. Apparatus for improved use of gas discharge energy for smoke suppression, comprising:

a plurality of horizontally spaced apart burner assemblies, each assembly comprising:

(a) a burner assembly having a vertical axis and a plurality of outwardly spaced tubular arms;

(b) a plurality of orifices in the top surfaces of said arms, the axes of said orifices directed upwardly in radial planes and inclined at a selected angle "A" to the axis of said burner;

(c) means to supply a combustible gas under selected pressure to each of said burner assemblies, and means to ignite said gas above said burner assemblies;

whereby, said gas will issue as high velocity jets from each of said orifices, and will entrain and aspirate air through the angular openings between said arms, and will turbulently mix said gas and air, whereby said inclined jets of gas will intersect along the axis of said burner at a selected point above said burner, and will proceed as a single vertical jet of gas, air and flame; and (d) each of said burner assemblies being spaced from each other, and from any confining structure, whereby combustion air is free to flow upwardly along both sides of said arms to be freely aspirated into and turbulently mixed with the high velocity jets of gas issuing from said orifices.

2. The burner as in claim 1 in which each of said radial arms comprise thin walled pipe, and in which said orifices are drilled perpendicular to the axes of said arms, and in which said arms are tilted upwardly at said angle "A".

3. The burner as in claim 1 in which said burner assembly includes a thick plane top plate, which extends over the top of said arms, and in which said orifices are drilled into said top plate at said angle "A".

4. The burner as in claim 1 including an axial vertical pipe for supplying gas to burner.

5. The burner as in claim 1 including at least one orifice in the top of, and at the axis of said burner assembly, said orifice covered with a plate spaced above said top;

whereby a quiet space will be provided for combustion of gas, as a pilot, to kindle the gas jets issuing from said arms.

6. A burner assembly comprising;

a vertical conduit having arranged at its upper end thereof a plurality of outwardly spaced tubular arms;

a plurality of orifices in the top surfaces of said arms, directed upwardly at a selected angle "A" to the vertically axis of said conduit;

means to supply a combustible gas under pressure to said burner assembly; and means to ignite said gas above said burner assembly;

whereby said gas will issue as high velocity jets from each of said orifices, and will entrain and aspirate air through the openings between said arms to turbulently mix said gas and air, whereby said jets of gas will be directed to a selected point above said burner assembly;

said burner assembly being spaced from any confining structure, whereby combustion air is free to flow upwardly along both sides of said arms to be freely aspirated into and turbulently mixed with the high velocity jets of gas issuing from said orifices.

7. A burner as in claim 6 in which said tubular arms are directed horizontally radially outward from said conduit, whereby said inclined jets of gas will intersect along the axis of said conduit at a selected point thereabove so as to then proceed as a single vertical jet of gas, air and flame.

8. The burner assembly as in claim 7 in which each of said radial arms comprise a thin-walled conduit and in which said orifices are drilled perpendicular to the axis of said arms, and in which said arms are angularly directed upwardly and outwardly at said angle "A".

9. Apparatus for improved use of gas discharge energy for smoke suppression, comprising:

at least one burner assembly comprising;

(a) at least one tubular member positioned substantially in a horizontal plane and free from any confining structure;

(b) a plurality of orifices in the top surface of said at least one member; the axes of said orifices directed upwardly to intersect in a selected point above said burner;

(c) means to supply a combustible gas at selected pressure to said at least one member, and means to ignite said gas issuing in jets from said orifices above said burner assembly;

whereby the high velocity jets of gas issuing from said orifices will intersect at a point above said burner.

10. The apparatus as in claim 9 and including:

at least one auxiliary orifice substantially in the plane of said plurality of orifices; said auxiliary orifice shielded from the high velocity flow of said gas jets and aspirated air;

whereby a quiet space will be provided for stable combustion of gas from said auxiliary orifice, as a pilot, to kindle the gas jets issuing from said plurality of orifices.

11. The apparatus as in claim 9, including a plurality of tubular elements, angularly spaced in a horizontal pattern, radiating from a central vertical conduit.

12. The apparatus as in claim 9 in which said tubular member comprises a horizontal circular toroidal structure.

13. The apparatus as in claim 11 in which said plurality of orifices in each of said radial arms are drilled so that the axes of said orifices interact at a point above and along the axis of said central conduit.

14. The apparatus as in claim 13 in which said arms are horizontal and the axes of said orifices are at an angle.

15. The apparatus as in claim 13 in which said orifices are drilled perpendicular to the surface of said arms, and said arms are tilted.

16. The apparatus as in claim 10 in which said auxiliary orifice is positioned along the axis of said vertical conduit, and is covered with a spaced plate.

* * * * *